US006575184B2

(12) United States Patent
Kozak

(10) Patent No.: US 6,575,184 B2
(45) Date of Patent: Jun. 10, 2003

(54) METHOD AND APPARATUS FOR SINGLE HANDED ERECTION OF LARGE TENTS

(76) Inventor: David A. Kozak, 120 W. 8th St., Pennsburg, PA (US) 18073

( * ) Notice: Subject to any disclaimer, the term of this patent is extended or adjusted under 35 U.S.C. 154(b) by 107 days.

(21) Appl. No.: 09/812,397

(22) Filed: Mar. 20, 2001

(65) Prior Publication Data

US 2002/0134418 A1 Sep. 26, 2002

(51) Int. Cl.[7] ..... E04H 12/34; E04H 15/00; B66F 11/00

(52) U.S. Cl. ..... 135/120.1; 135/905; 414/23; 254/264; 254/266

(58) Field of Search ..... 135/905, 120.1, 135/87, 99; 414/23; 254/264, 266, 323

(56) References Cited

U.S. PATENT DOCUMENTS 1,018,970 A * 2/1912 Gardiner ..... 254/220
2,988,331 A * 6/1961 Carlson ..... 192/116.5
3,093,088 A * 6/1963 Ventress ..... 417/141
3,159,368 A * 12/1964 Ahlbin et al. ..... 224/520
3,807,577 A * 4/1974 Bell ..... 104/173.1
3,946,990 A * 3/1976 Tanner ..... 248/156
4,457,035 A * 7/1984 Habegger et al. ..... 14/18
5,248,157 A * 9/1993 Rice ..... 135/905
5,519,965 A * 5/1996 Robinson ..... 428/907
5,522,582 A * 6/1996 Dilks ..... 242/587.2
5,924,832 A * 7/1999 Rice ..... 135/908
6,386,514 B1 * 5/2002 Ray ..... 254/323

* cited by examiner

*Primary Examiner*—Robert J Canfield
(74) *Attorney, Agent, or Firm*—RatnerPrestia

(57) ABSTRACT

Method and apparatus for single handed erection of a tent pole having a tent supporting end and a ground end the ground end supported in a carrier pulled along the ground to position the ground end of the pole beneath the portion of the tent contacting the tent supporting end of the tent pole. The apparatus uses a cable connected to a receptacle fitted over the ground end of the tent pole with the cable wound around a cable drum of a winch, the receptacle supported by wheels, rollers or skids to move along the ground as the cable is wound onto the drum. A motorized winch and remote control place the user outside the tent as it is erected.

3 Claims, 4 Drawing Sheets

FIG. 1
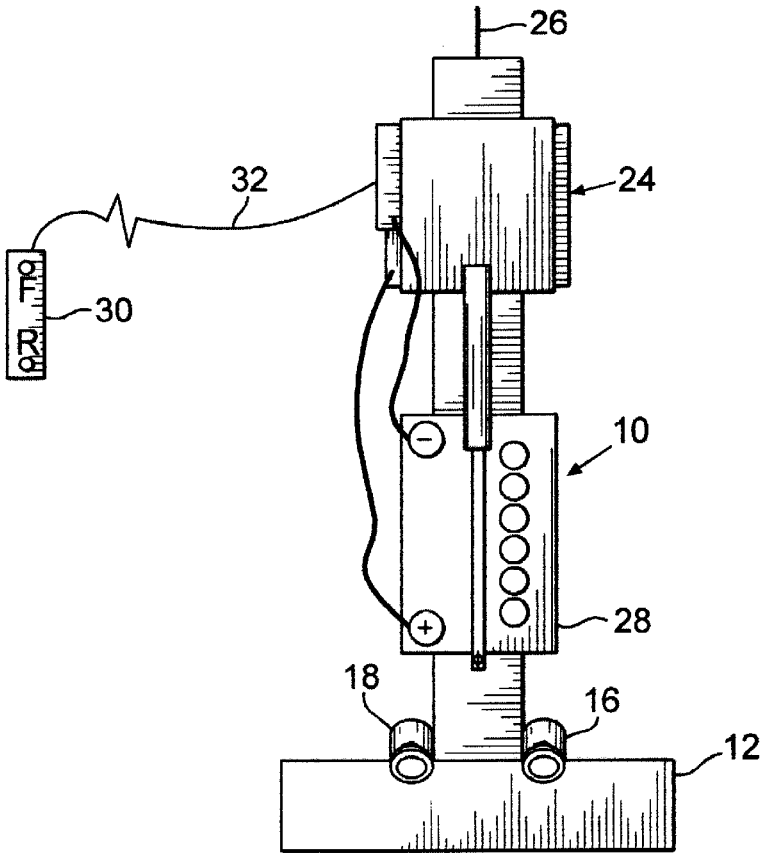
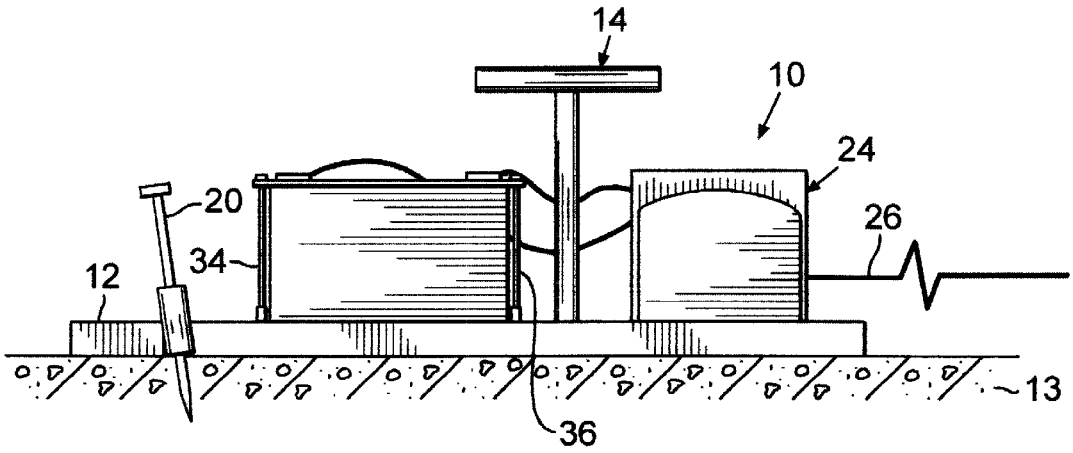
FIG. 2

METHOD AND APPARATUS FOR SINGLE HANDED ERECTION OF LARGE TENTS

BACKGROUND OF THE INVENTION

The present invention pertains to setting up or erection of large tents such as those used for garden parties, wedding receptions and the like.

Most large tents have one if not several main tent poles, which support the canopy or roof of the tent when it is fully erected. The main tent poles in combination with side poles, ropes and stakes secure the tent in position.

When erecting a large tent the tent material is fully laid out in the area in which the tent will rise. The tent poles having a tent end (an end that supports the tent material) and a second or distal end which sits on the ground (ground end) are placed underneath the tent by physically going under the tent and erecting the tent poles. It can take many men to set up the poles and hold them in place, until the side poles and ropes are put into place and fastened.

Tent erection is by and large a manual task and any improvements to erecting tents would be a strict advance in the art.

BRIEF DESCRIPTION OF THE INVENTION

The present invention is a method and apparatus for single handed erection of the main poles of a tent by inserting the ground end of the tent pole in a carrier which can be drawn along the ground in a direction toward the spot where the ground end of the tent pole should be placed in its fully erected position.

Therefore, in one aspect the present invention is an apparatus for raising a tent pole from a horizontal position to a vertical position comprising in combination: a base having means to fix the base to the ground proximate a final position for a ground end of the tent pole; a winch mounted on the base, the winch having a cable winding drum with a cable, the cable having a first end fixed to the cable drum, the cable adapted to be payed off and wound around the cable drum, and the cable having a second or free end having means to hold the ground end of the tent pole, the means adapted to move the tent pole from a generally longitudinal position to a vertical position when the cable is wound onto the cable drum.

In another aspect, the present invention is a method for raising a tent supported by a tent pole comprising the steps of: spreading the tent on the ground; positioning the tent supporting end of the tent pole proximate an inner surface of the tent as dictated by a configuration of the tent being raised; inserting a ground end of the tent pole in a receptacle adapted to be moved along the ground and gradually raising the tent pole from a generally horizontal to a generally vertical position by moving the receptacle along the ground to position the tent pole in an upright position.

BRIEF DESCRIPTION OF THE DRAWING

FIG. 1 is a top plan view of an apparatus according to the invention.

FIG. 2 is a right side elevational view of the apparatus of FIG. 1.

DETAILED DESCRIPTION OF THE INVENTION

Figure 3:
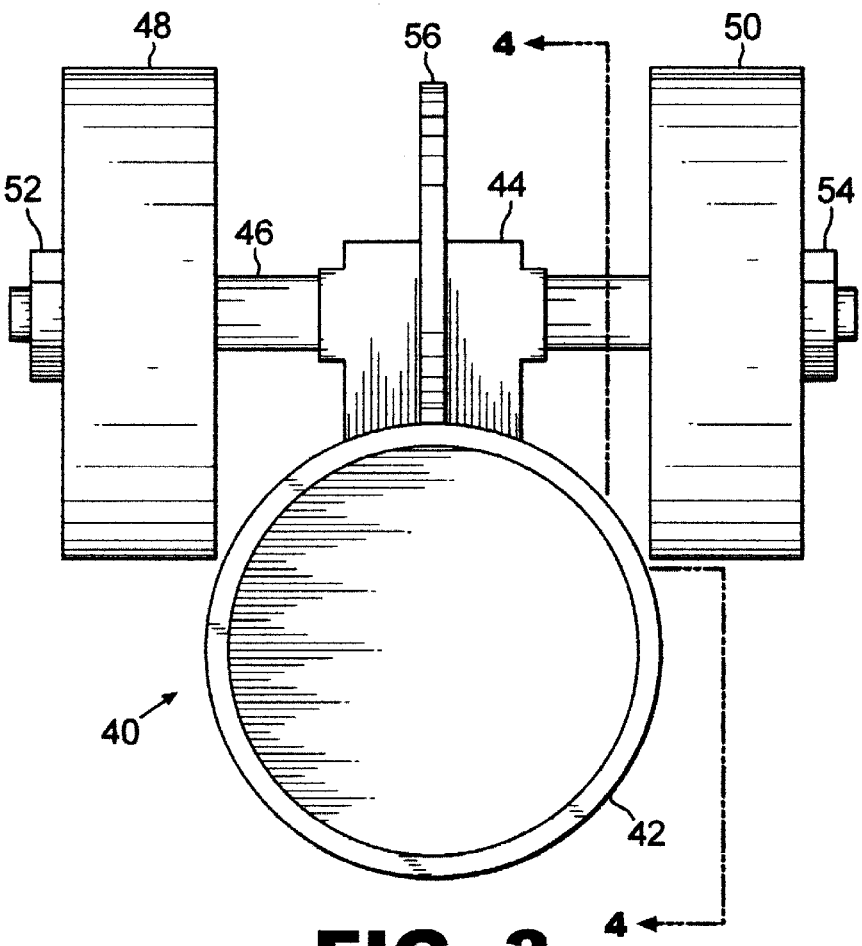
FIG. 3 is an enlarged top plan view of the receptacle for the ground end of the tent pole.
Figure 4:
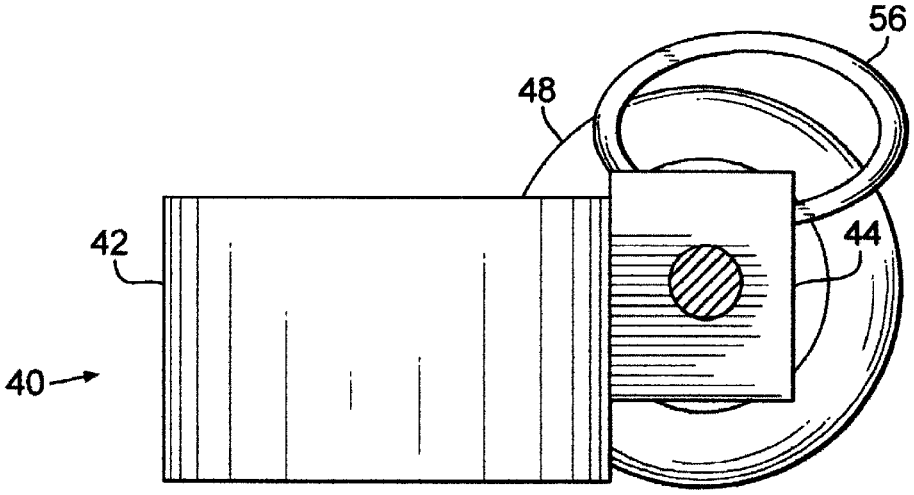
FIG. 4 is a view taken along lines 4—4 of FIG. 3.

Referring to FIG. 1, the apparatus of the present invention, shown generally as 10, includes a base 12, which may be fabricated from any structural material. In a preferred embodiment of the invention, the base 12 is fabricated from a metal plate. The base 12 has a generally T-shaped configuration and includes a carrying handle 14, so that the device is totally portable. Base 12 includes a pair of collars or adapters 16 and 18 which can be used in combination with a spike or tent stake, e g. tent stake 20 shown in FIG. 2, to secure the base 12 to the surface 13 upon which the tent is to be erected.

Mounted onto base plate 12 is a twelve volt motorized winch 24, that can be run in a forward or reverse direction, which has a drum (not shown) upon which is wound a cable or wire rope 26. The winch 24 includes a motor that can be powered by a conventional twelve volt garden tractor or automotive battery 28. Winch 24 can be of the type that is used on off-road vehicles as is well known in the automotive art. The motor of the winch 24 can be controlled by a push button remote control 30, which can be connected to the motor portion of the winch 24 by a suitable electrical conduit 32. The battery 28 can be removably attached to the base plate 12 by a pair of threaded posts 34, 36, such as used to hold an automotive battery under the hood of a conventional automobile.

Referring to FIG. 3 the pole supporting device, shown generally as 40, includes a cup shaped holder 42 which will support the ground end of the tent pole as it is moved from a generally horizontal position to a generally vertical position, without allowing the ground end of the tent pole to touch the ground as it is being moved. Fastened to the cup portion 42 of supporting device 40 is an axle support member 44 which, includes an axle 46 adapted to receive a pair of wheels 48, 50, the wheels held to the axle by suitable fasteners 52, 54. The fasteners 52, 54 can be lock nuts or any other convenient mechanism that will position the wheels 48, 50, on the shaft 46 and permit the wheels to freely rotate. Fastened to the support 44 is a ring member 56, which permits the free end of cable 26 to be connected to the support apparatus 44, either permanently or removably by means of a hook, snap fastener or other device mounted on the free end of the cable 26. Since such devices are well known in the art, the have not been included in the drawing for the sake of clarity.

Figure 5:
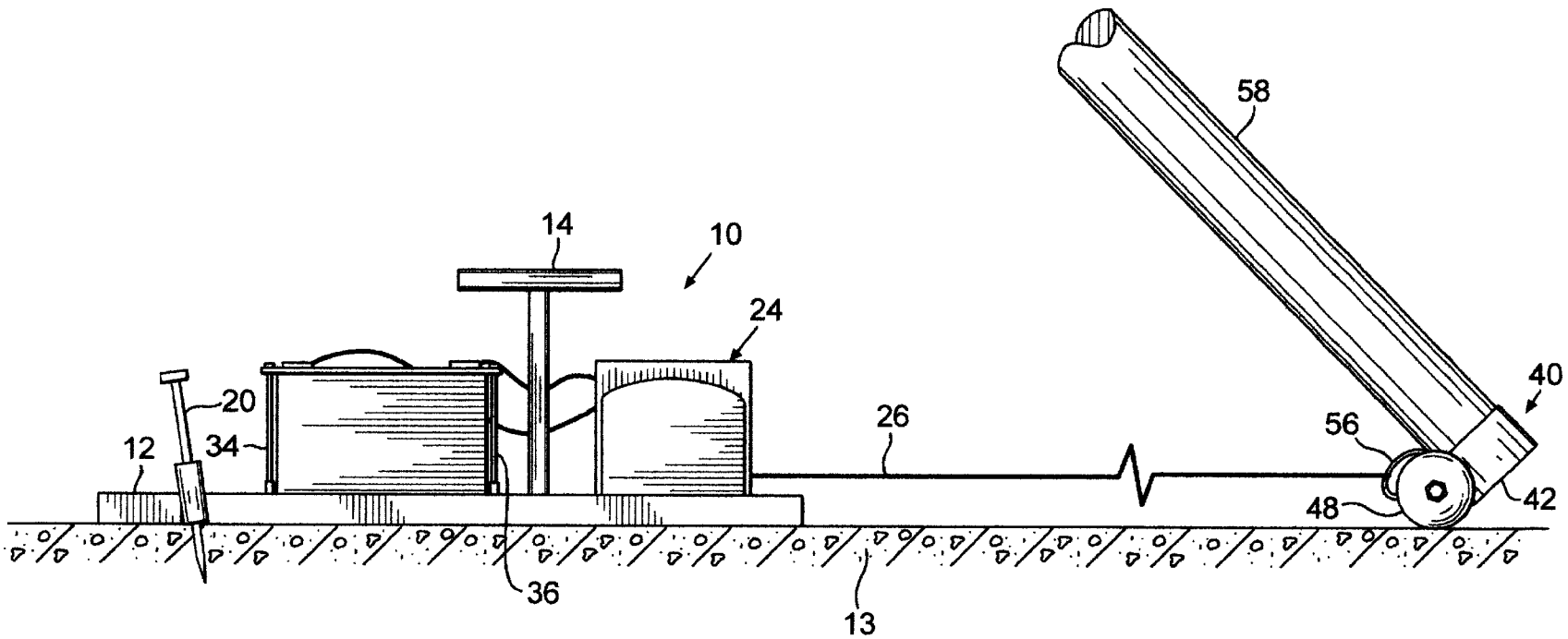
FIG. 5 is a front elevational view illustrating the method of the present invention.
Figure 6:
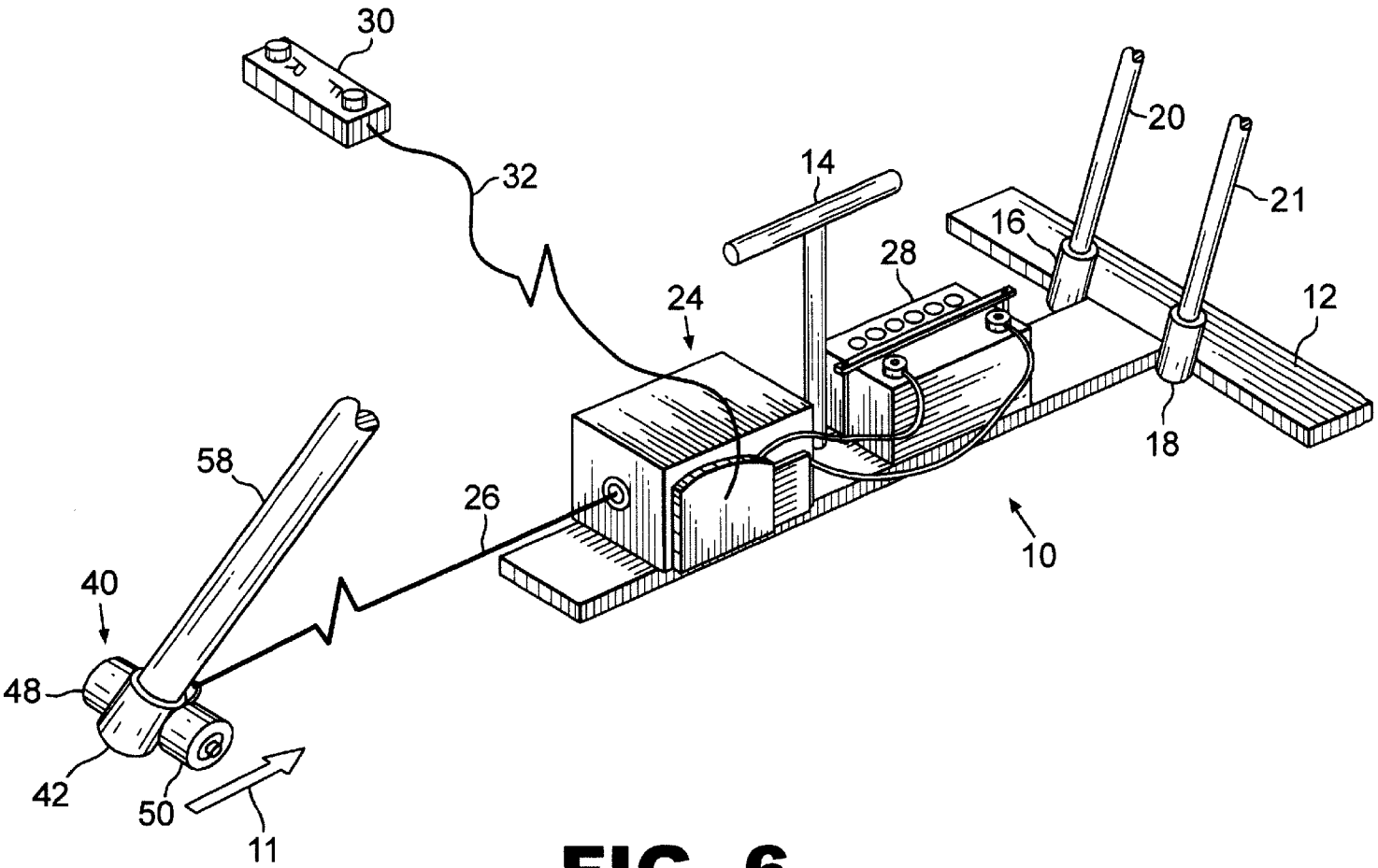
FIG. 6 is a perspective view illustrating the method and apparatus of the present invention employing a remote control apparatus.

As shown in FIGS. 5 and 6, when a tent pole 58 is to be erected, the base portion of the apparatus 10 is positioned proximate the final location where the ground end of the tent pole 58 will sit. Cable 26 is extended outwardly from the winch 24 and the tent end of the pole (not shown) is placed in the receiving portion of the tent as is well known in the art with the tent end of the tent pole 58 proximate the location where the tent pole 58 will stand when raised to a vertical position. The ground end of tent pole 58 is placed in cup portion 42 of pole supporting device 40 and the tent pole 58 aligned with cable 26. The motor on the winch 24 can then be energized and the cable wound on the drum in the direction shown by arrow 11 in FIG. 6. As the cable 26 is wound onto the drum the tent pole is slowly brought into the vertical position and when it is proximate the place to where it will sit, the winch is stopped and the pole 58 can be lifted from the holder 42 of carriage 40 and placed upon the ground. The apparatus 10 of the invention operates in a manner that would replace individuals erecting the tent poles. In a like manner, without the apparatus of the present invention, individuals erecting a tent would grasp the pole near the ground end and walk it toward its final resting place on the ground. The apparatus 10 of the invention replicates this action and enables a single person to erect tent poles for a large tent. The tension on the cable is maintained because of the weight of the tent material exerted on the tent pole 58 as it is moved into position.

For convenience sake the winch 24 should include a reversible motor to aid in extending the cable prior to erection of the pole 58. As shown clearly in FIG. 6, stakes 20 and 21 can be used to position the apparatus 10 so it will not move as the tent stake is urged toward the apparatus 10. The remote control switch can be positioned so that the operator is outside of the tent material as the tent is being erected.

A plurality of devices such as shown in FIGS. 1 through 6 can be employed to raise a plurality of tent poles simultaneously.

The method and apparatus of the invention permits erecting large tents with one or two people without exerting undo effort to erect the main tent poles.

Having thus described my invention what is desired to be secured by Letters Patent of the United States is set forth in the appended claims.

What is claimed:

1. An apparatus for raising a tent pole from a horizontal position to a vertical position comprising in combination:

a base having means to securely fix said base to the ground proximate a final position for a ground end of said tent pole;

a winch mounted on said base said winch having a cable winding drum with a cable, said cable having a first end fixed to said cable drum, said cable adapted to be payed off and wound around said cable drum;

a motor and power source on said base to drive said winch, said motor including remote control means for energizing and de-energizing said motor; and said cable having a second or free end connected to a generally cup shaped receptacle adapted to contain said ground end of said tent pole, said cup shaped receptacle supported at least partially between a pair of wheels, said cup shaped receptacle connected to said free end of said cable in order to move said cup shaped receptacle along said ground as said cable is wound onto said drum whereby said tent pole is gradually raised from a generally horizontal to a generally vertical position.

2. An apparatus according to claim 1, including at least two holders on said base adapted to securely position said base using elongated rods or tent stakes.

3. A method for raising a tent supported by a tent pole comprising the steps of:

spreading said tent on the ground;

positioning a tent supporting end of said tent pole where dictated by a configuration of said tent being raised, with said tent pole extending in a generally horizontal position;

inserting a ground end of said tent pole in a cup shaped receptacle fixed between a pair of wheels, said cup shaped receptacle fixed to the free end of a cable disposed around a winding drum driven by a remotely operated motor, said winding drum and motor rigidly fixed to said ground proximate the final location of said ground end of said tent pole whereby said cup shaped receptacle can be moved along the ground to gradually raise said tent pole from a generally horizontal to a generally vertical position as said cup shaped receptacle moves along said ground toward said drum.

* * * * *